US005902175A

United States Patent [19]

De Goede et al.

[11] Patent Number: 5,902,175

[45] Date of Patent: May 11, 1999

[54] CLEANING OF SURFACES BELOW THE LEVEL OF A LIQUID

[75] Inventors: Leon De Goede; Mark De Goede, both of Pretoria, South Africa

[73] Assignee: GYDA Marketing (Proprietary) Limited, Valfalla, South Africa

[21] Appl. No.: 08/858,976

[22] Filed: May 20, 1997

[30] Foreign Application Priority Data

May 24, 1996 [ZA] South Africa ..... 96/4202
Mar. 26, 1997 [ZA] South Africa ..... 97/2637

[51] Int. Cl.[6] ..... B24B 23/00

[52] U.S. Cl. ..... 451/456; 451/354; 15/1.7

[58] Field of Search ..... 451/456, 354, 451/344, 524, 523, 557, 530, 527, 536, 526, 538; 15/1.7

[56] References Cited

U.S. PATENT DOCUMENTS 3,273,187 9/1966 Williams ..... 15/1.7
4,023,227 5/1977 Chauvier ..... 15/1.7
4,156,948 6/1979 Chauvier et al. ..... 15/1.7
4,609,581 9/1986 Ott ..... 451/490
5,197,249 3/1993 Wiand ..... 451/530
5,361,442 11/1994 Payne et al. ..... 15/1.7

FOREIGN PATENT DOCUMENTS

71/0231 1/1971 South Africa .

*Primary Examiner*—Robert A. Rose
*Attorney, Agent, or Firm*—Marshall, O'Toole, Gerstein, Murray & Borun

[57] ABSTRACT

A cleaning member for a submerged surface cleaning device comprises a flexible disc-like body having an operatively upper surface and an operatively lower surface. The body is adapted for connection to a submerged surface cleaning device. Abrasion means is provided on at least a portion of the lower surface of the body.

15 Claims, 2 Drawing Sheets

CLEANING OF SURFACES BELOW THE LEVEL OF A LIQUID

FIELD OF THE INVENTION

THIS INVENTION relates to the cleaning of surfaces below the level of a liquid. It relates in particular to a cleaning member for a submerged surface cleaning device, to such a cleaning device, and to an abrasive pad for such a cleaning member.

BACKGROUND OF THE INVENTION

The Applicant is aware of a submerged surface cleaning device for cleaning surfaces below the level of a liquid such as water, e.g. for cleaning underwater swimming pool surfaces. The cleaning device comprises a cleaning head; a flexible cleaning member, connected or attached to the head in such a fashion that an operatively lower surface of the cleaning member engages the surface to be cleaned, with an operatively underside of the cleaning member being in communication with a suction chamber in the cleaning head by means of a liquid inlet leading into the suction chamber and a complementary aperture in the cleaning member; an outlet leading from the suction chamber for permitting suction to be applied, through a flexible suction hose or pipe, to the suction chamber; and automatic actuating means, e.g. a valve or diaphragm system, for enabling suction to the suction chamber, and hence to the underside of the flexible cleaning member, to be cut off and reapplied periodically. Thus, in use, when suction is applied, liquid can pass along the flexible suction pipe or conduit with the flexible cleaning member then being in suction contact with an underwater surface to be cleaned and, when suction is cut off or interrupted, liquid in the pipe will cause the pipe to flex thereby to move the head and flexible cleaning member along the surface before suction is re-applied.

OBJECT OF THE INVENTION

It is an object of the invention to provide means whereby the cleaning efficacy of the cleaning member of such a cleaning device can be improved.

BROAD DESCRIPTION OF THE INVENTION

According to a first aspect of the invention, there is provided a cleaning member for a submerged surface cleaning device of the kind comprising a cleaning head having a suction chamber, a liquid inlet leading into the suction chamber, and a liquid outlet leading from the suction chamber, with the outlet being connectable, by means of a flexible hose, to suction generating means whereby suction can be applied to the suction chamber; a flexible cleaning member releasably connected to the cleaning head, the cleaning member having an aperture which is complimentary to the liquid inlet of the cleaning head so that an operatively underside of the cleaning member is in flow communication with the suction chamber whereby suction can be applied to the underside of the cleaning member through the aperture therein; and automatic actuating means in the cleaning head for enabling the suction to the underside of the cleaning member to be interrupted and reapplied periodically, the cleaning member comprising a flexible body having an operatively upper surface and an operatively lower surface, and an aperture therein, the body being releasably connectable to the cleaning head of the cleaning device such that the aperture is in flow communication with the liquid inlet thereof, to permit suction to be applied to an underside of the flexible body below its operatively lower surface, when suction is applied to the suction chamber of the head; and abrasion means on, or protruding from, at least a portion of the lower surface of the body.

The body may be more-or-less circular, with the aperture located centrally therein. Thus, the body may be disc-shaped with the aperture located centrally in the body. The cleaning member may be of flexible plastics material such as polyvinylchloride (PVC) or polyurethane, rubber material, or composites of such materials.

The abrasion means may be provided on a plurality of spaced portions or zones of the lower surface of the body. These portions or zones may be spaced circumferentially apart. In one embodiment of the invention, the portions or zones may extend from the inner periphery of the disc to its outer periphery, or from near its inner periphery to near its outer periphery. However, in another embodiment of the invention, the portions or zones may extend only a portion of the distance from the inner periphery to the outer periphery. The portions or zones provided with the abrasion means may be of any desired shape. For example, they may be more-or-less fan-shaped, being broader along their outer edges than along their inner edges. Instead, they may be essentially fan-shaped with curved portions so that they resemble a spiral, to facilitate rotation of the disc during operation. In a preferred embodiment, the portions or zones may be defined by sectors, or parts of sectors, of the disc-shaped body.

The abrasion means may be secured to the disc by any suitable means. Thus, in one embodiment, the abrasion means may be embedded in the disc. In another embodiment, the abrasion means may be adhesively or otherwise secured to the lower surface of the disc.

The abrasion means may comprise an abrasive pad in each sector, or sector part, with each pad being secured to the body such that a portion thereof protrudes beyond the lower surface of the body. Each abrasive pad may be releasably attached to the body of the cleaning member. The releasable attachment thereof to the body may be effected by means of two-component hook-and-loop or stem-and-head attachment means. One component of the hook-and-loop or stem-and-head attachment means may be adhesively attached to the body, while another component thereof may be formed integrally with the abrasive pad.

The abrasive pads may be located in recesses in the lower surface of the body. Each abrasive pad may comprise a web of non-woven synthetic fibres having abrasive mineral particles bonded thereto. The fibres and particles will be selected to give a desired degree of abrasion e.g. coarse, medium or fine abrasion.

Instead, the abrasion means may comprise abrasive particles secured to the body of the cleaning member, such as ceramic particles, eg silicon carbide or nitride particles, such as those available in South Africa under the trademarks ALUNDUM and CRYSTOLON. The size of the particles and/or the particle density on the body will be selected to give a desired degree of abrasion.

The abrasive particles may be between grit 50 and grit 800. If a coarse abrasive effect on the underwater surface is desired as the disc moves across the surface, the abrasive particles may be between grit 50 and grit 200, and between grit 200 and grit 800, if a fine abrasive effect is required.

Abrasion means may also be provided on an operatively upper surface of the body. This will render the body reversible, in use. In other words, if the abrasion means on the lower surface becomes worn in use, the body can then be inverted so that the upper surface then becomes the operatively lower surface with which the pool surface is cleaned.

When abrasion means are provided on both surfaces of the body, the abrasion means on the respective surfaces may either be similar or dissimilar. Thus, coarse abrasion means may be provided on both surfaces, or fine abrasion means may be provided on both surfaces. Instead, however, coarse abrasion means may be provided on one of the surfaces with fine abrasion means then being provided on the other of the surfaces. Thus, in use, either the surface with coarse abrasion means or the surface with fine abrasion means will be lowermost or downwardly directed, depending on the degree of abrasiveness required for cleaning the pool surface.

According to a second aspect of the invention, there is provided a cleaning member for a submerged surface cleaning device, the cleaning member comprising a flexible disc-like body having an operatively upper surface and an operatively lower surface, and being adapted for connection to a submerged surface cleaning device; and abrasion means on at least a portion of the lower surface of the body.

Abrasion means may then also be provided on the upper surface of the body, as hereinbefore described. The body and the abrasion means may be as hereinbefore described.

According to a third aspect of the invention, there is provided a cleaning device comprising a cleaning head having a suction chamber, a liquid inlet leading into the suction chamber, and a liquid outlet leading from the suction chamber, with the outlet being connectable, by means of a flexible hose, to suction generating means whereby suction can be applied to the suction chamber;

a flexible cleaning member releasably connected to the cleaning head, the cleaning member comprising a flexible body having an operatively upper surface and an operatively lower surface, and an aperture therein, the body being releasably connected to the cleaning head such that the aperture is in flow communication with the liquid inlet thereof, to permit suction to be applied to an underside of the flexible body below its operatively lower surface, when suction is applied to the suction chamber of the head; and abrasion means on, or protruding from, at least a portion of the lower surface of the body; and automatic actuating means in the cleaning head for enabling the suction to the underside of the cleaning member to be interrupted and reapplied periodically.

According to a fourth aspect of the invention, there is provided an abrasive pad for a cleaning member for a submerged surface cleaning device, the abrasive pad comprising an attachment component for releasably attaching the abrasive pad to a lower surface of the cleaning member; and an abrasive layer attached to the attachment component, the abrasive pad having a shape which is complimentary to that of an attachment zone on the lower surface of the cleaning member.

The attachment component may comprise one component of a two-component hook-and-loop or a two-component stem-and-head attachment means, as hereinbefore described. The abrasive layer may comprise a web of non-woven synthetic fibres having abrasive mineral particles bonded thereto, as also hereinbefore described.

The invention will now be described, by way of example, with reference to the accompanying diagrammatic drawings.

DETAILED DESCRIPTION OF THE DRAWINGS

Figure 1:
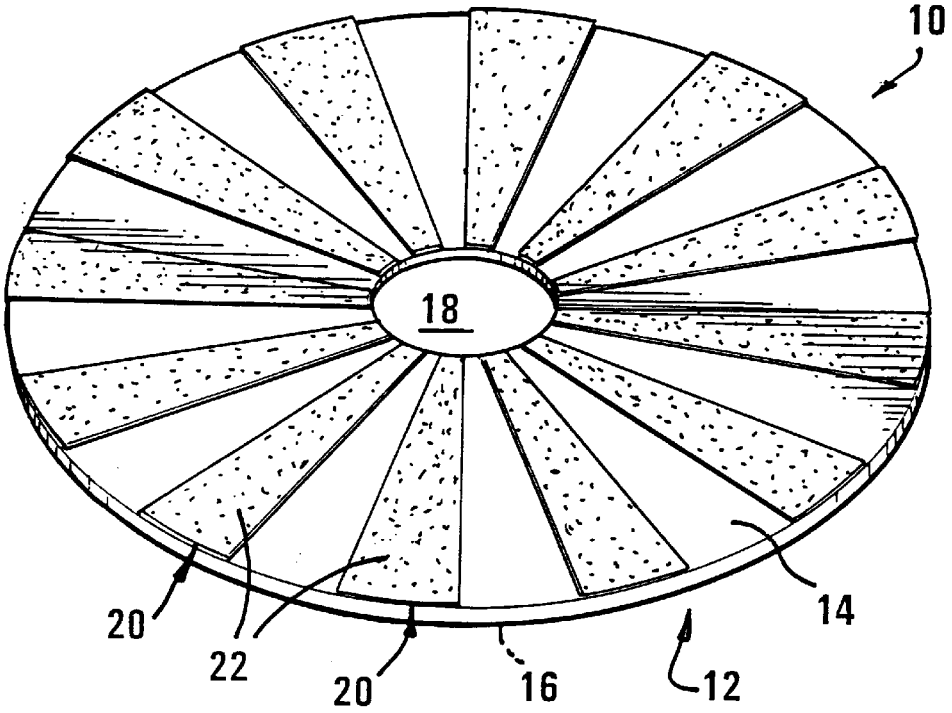
FIG. 1 shows a three-dimensional view of the under side of a cleaning member according to one embodiment of the first and second aspect of the invention.
Figure 2:
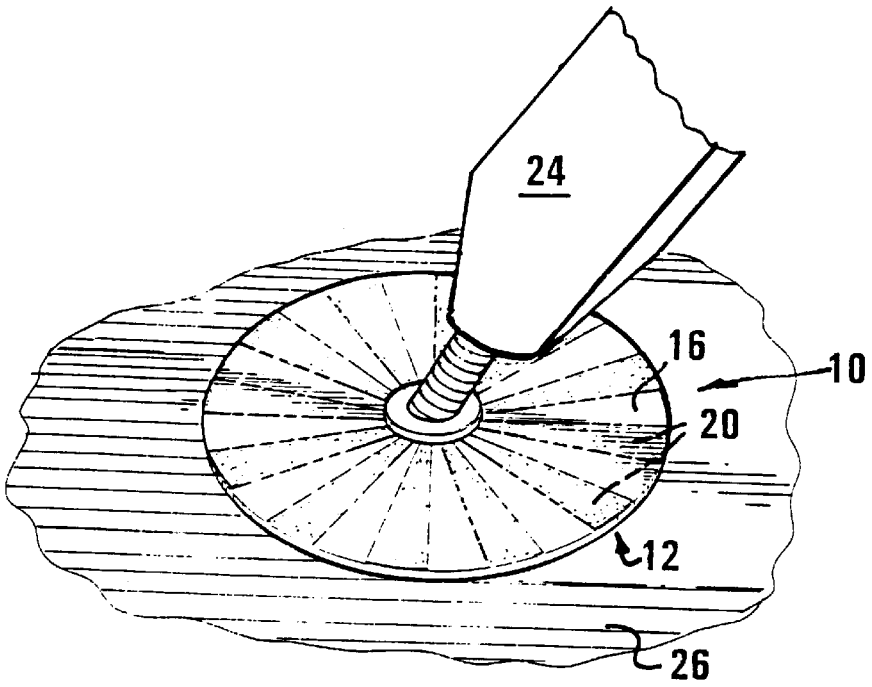
FIG. 2 shows a three-dimensional view of part of a cleaning device according to the third aspect of the invention, and incorporating the cleaning member of FIG. 1.

Referring to FIGS. 1 and 2, reference numeral 10 generally indicates a cleaning member according to the invention.

The cleaning member 10 comprises a flexible disc-like body 12 having an operatively lower surface 14 as well as an operatively upper surface 16. A central aperture 18 is provided in the body. The body 12 is of flexible plastics material such as PVC or polyurethane, or flexible rubber material, or composites of such materials. Typically, the thickness of the body 12 may be about 2 to 4 mm, and it may have a diameter of about 40 cm.

On the lower surface 14 of the body 12 are provided a plurality of circumferentially spaced fan shaped zones 20 containing abrasive particles 22. The zones 20 extend from the inner periphery of the body 12 to its outer periphery. The zones 20 are thus defined by sectors of the disc-like body 12. Instead of the zones 20 being fan shaped, they can be of any other desired shape.

The average particle size of the abrasive particles 22 is selected to give a desired abrasive effect in use. Thus the particles may be between 50 and 200 grit if a course abrasive effect is required, while the particles can be between 200 and 800 grit if a fine abrasive effect is required. The abrasive particles are typically hardened, eg ceramic particles. For example, they may be Carborundum (trade mark) particles. The particles are secured to the body 12 by being embedded in the plastics material of the body. Instead, however, they can be attached adhesively thereto.

If desired, similar zones (not shown) containing abrasive particles can be provided on the upper surface 16. This renders the body 12 reversible, as hereinbefore described. The particles of the upper and lower surfaces may then be the same or different as hereinbefore described.

In use, the cleaning member 10 is attached to the cleaning head 24 of a submerged surface cleaning device for cleaning an underwater surface 26, such as the surface of a swimming pool. This connection is effected in known manner, such that the operatively lower surface 14 is downwardly directed, with the aperture 18 being in communication with a water inlet leading into a suction chamber in the head 24. The cleaning device may thus be the same or similar to that available in South Africa under the trademarks BARRACUDA, KREEPY KRAULY, or the like.

In use, as the cleaning member 10 moves along the surface 26 in known fashion, due to suction being cyclically applied through a flexible hose (not shown) to the suction chamber in the head 24, and hence, via the water inlet to the suction chamber and the aperture 18, to the underside of the cleaning member 10, and interrupted as hereinbefore described, the abrasive particles 22 serve to scour the surface 26, thereby removing fixed deposits such as algae, discolourations etc. from the surface 26.

Figure 3:
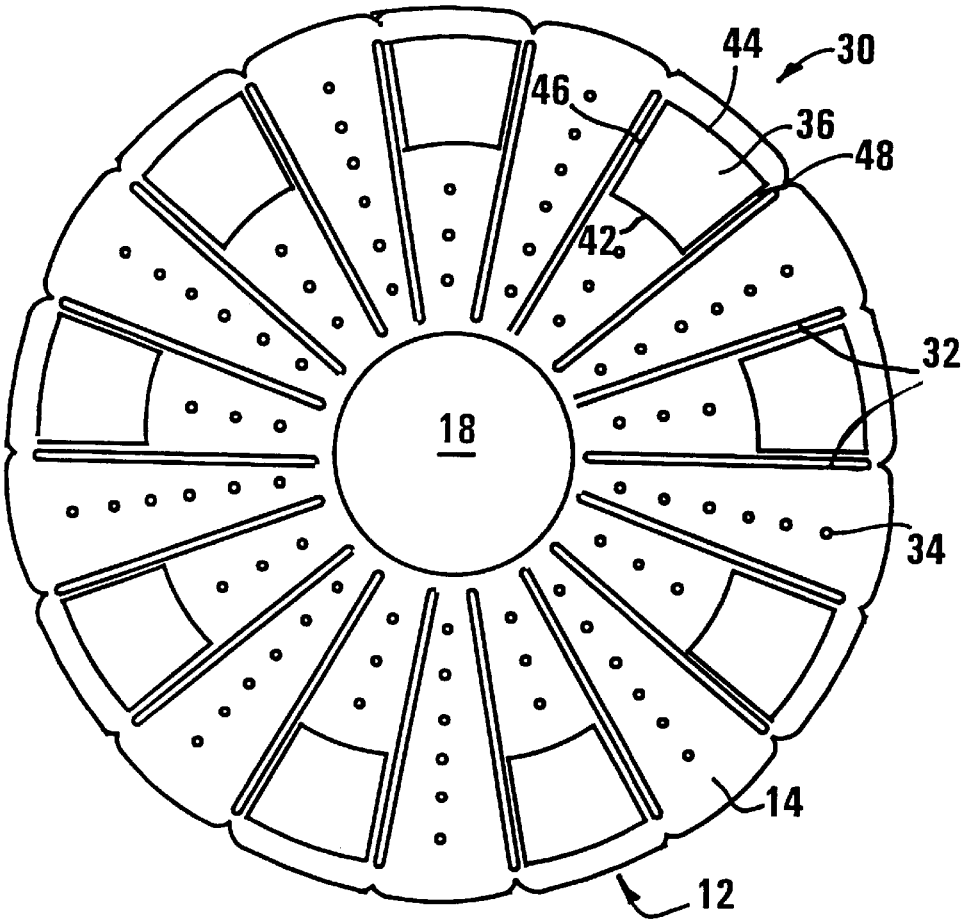
FIG. 3 shows a bottom plan view of the under side of another embodiment of a cleaning member according to the first and second aspects of the invention.
Figure 4:
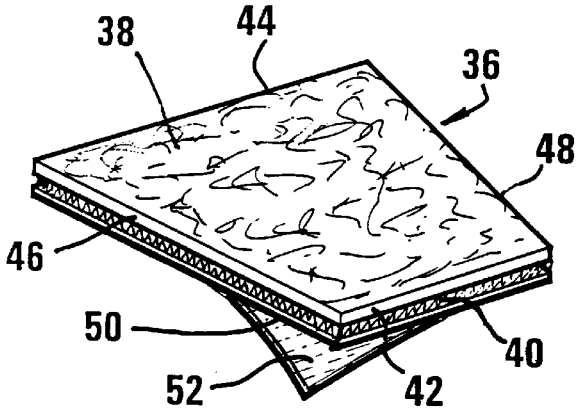
FIG. 4 shows a three-dimensional view of one of the abrasive pads of the cleaning member of FIG. 3.

Referring to FIGS. 3 and 4, another cleaning member in accordance with the invention is generally indicated by reference numeral 30. Unless otherwise indicated the same reference numerals used in FIGS. 1 and 2 are used to designate the same or similar parts or features in the cleaning member 30.

The flexible disc-like body 12 of the cleaning member 30 has radially extending grooves 32 and a plurality of holes 34, which impart greater lateral flexibility to the body 12. The grooves 32 define a plurality of circumpherentially spaced sectors of the disc-like body 12, which in turn provide the zones containing the abrasion means.

Unlike the cleaning member 10, the abrasion means of the cleaning member 30 comprises an abrasive pad 36 in each sector part or zone.

Each abrasive pad 36 comprises a web 38 of non-woven synthetic fibres having abrasive mineral particles bonded thereto, and an attachment component 40 for releasably attaching the abrasive pad to the lower surface 14 of the cleaning member 30. Each abrasive pad 36 has a shape which is complementary to that of the zones. Thus, each pad 36 has, in plan view, a shorter slightly curved inner edge 42, a somewhat longer also slightly curved outer edge 44, and spaced straight side edges 46, 48 diverging outwardly from the inner edge 42 to the outer edge 44. Thus, the inner and outer edges are defined by arcs i.e. are arcuate shaped. Typically, the abrasive pads are similar to abrasive pads obtainable in South Africa from 3M SA (Pty) Ltd of 181 Barbara Road, Elandsfontein, South Africa, under the tradename Scotch-Brite (Trade Mark) and identified as cutting and polishing material.

The attachment component 40 is one component of a two-component hook-and-loop or a two-component stem-and-head attachment means. One example of such a stem-and-head attachment means is the Dual Lock (Trade Mark) recloseable fastening system with the product number SJ3552, type 170 stems, obtainable in South Africa from 3M South Africa (Pty) Ltd. The attachment component 40 is integral with the abrasive web or layer 38.

A second component 50 of the attachment means is adhesively attached to a zone of the body 12. A protective film 52 is initially provided over an adhesive coating on the second component 50 and is peeled off the second component 50 to expose the adhesive coating prior to attaching the second component 50 adhesively to the zone.

The cleaning member 30 is used in similar fashion to the cleaning member 10, with the abrasive pads 36 functioning in the same manner as the abrasive particles 22.

Hitherto, cleaning members used on underwater cleaning devices have had a substantially smooth lower surface so that they move along the surface 26 without any scouring action, serving only to suck up loose dirt and debris which has accumulated on the surface.

The Applicant believes that with the cleaning device according to the invention, and the cleaning members 10, 30, discolourations and deposits on underwater surfaces 26 can be removed easily and readily. Additionally, as a result of the abrasive particles 22 or pads 36, the overall traction of the cleaning device along the surface 26 is greatly improved, allowing the device to adhere readily to vertical surfaces of the swimming pool, thereby to clean such surfaces effectively.

We claim:

1. A cleaning device comprising a cleaning head having a suction chamber, a liquid inlet leading into the suction chamber, and a liquid outlet leading from the suction chamber, with the outlet being connectable, by means of a flexible hose, to suction generating means whereby suction can be applied to the suction chamber;

a flexible cleaning member releasably connected to the cleaning head, the cleaning member comprising a flexible body having an operatively upper surface and an operatively lower surface, and an aperture therein, the body being releasably connected to the cleaning head such that the aperture is in flow communication with the liquid inlet thereof, to permit suction to be applied to an underside of the flexible body below its operatively lower surface, when suction is applied to the suction chamber of the head; and at least one abrasive pad located in a recess in the lower surface of the body with a portion of the pad protruding beyond the lower surface of the body; and automatic actuating means in the cleaning head for enabling the suction to the underside of the cleaning member to be interrupted and reapplied periodically.

2. A cleaning member for a submerged surface cleaning device, the cleaning member comprising a flexible body having an operatively upper surface and an operatively lower surface, and an aperture therein, the body being releasably connectable to a cleaning head of a submerged surface cleaning device; and at least one abrasive pad located in a recess in the lower surface of the body, with a portion of the pad protruding beyond the lower surface of the body.

3. A cleaning member as claimed in claim 2, wherein a plurality of the abrasive pads is provided, with each pad being located in an associated recess in the lower surface of the body.

4. A cleaning device as claimed in claim 1, wherein a plurality of the abrasive pads is provided, with each pad being located in an associated recess in the lower surface of the flexible body of the flexible cleaning member.

5. A cleaning device as claimed in claim 4, wherein each abrasive pad is releasably attached to the body of the cleaning member by means of hook-and-loop attachment means, with a component of the hook-and-loop attachment means being attached to the body, and with another component thereof being farmed integrally with the abrasive pad.

6. A cleaning member as claimed in claim 3, wherein the body is disc-shaped with the aperture located centrally in the body, and wherein the recesses are provided in a plurality of spaced portions of the lower surface of the body.

7. A cleaning member as claimed in claim 3, wherein each abrasive pad comprises a web of non-woven synthetic fibres having abrasive mineral particles bonded thereto.

8. A cleaning member as claimed in claim 6, wherein the spaced portions of the lower surface of the body in which the recesses are provided, are defined by sectors of the disc-shaped body.

9. A cleaning member as claimed in claim 2, wherein at least one abrasive pad is also provided on the operatively upper surface of the body.

10. A cleaning member as claimed in claim 5, wherein each abrasive pad comprises a web of non-woven synthetic fibres having abrasive mineral particles bonded thereto, the web being formed integrally with another component of the hook-and-loop attachment means.

11. A cleaning device as claimed in claim 4, wherein the flexible body is disc-shaped with the aperture located centrally in the body, and wherein the recesses are provided in a plurality of spaced portions of the lower surface of the body.

12. A cleaning device as claimed in claim 11, wherein the spaced portions of the lower surface of the body in which the recesses are provided, are defined by sectors of the disc-shaped body.

13. A cleaning member as claimed in claim 3, wherein each abrasive pad is releasably attached to the body of the cleaning member by means of hook-and-loop attachment means, with a component of the hook-and-loop attachment means being attached to the body, and with another component thereof being formed integrally with the abrasive pad.

14. A cleaning device as claimed in claim 4, wherein each abrasive pad comprises a web of non-woven synthetic fibres having abrasive mineral particles bonded thereto.

15. A cleaning device as claimed in claim 1, wherein at least one abrasive pad is also provided on the operatively upper surface of the body.

* * * * *